US005979091A

United States Patent [19]

TenBrink

[11] Patent Number: 5,979,091

[45] Date of Patent: Nov. 9, 1999

[54] SNOWFALL SIMULATOR

[76] Inventor: Carl Evan TenBrink, 6851 Presidio Dr., Huntington Beach, Calif. 92648

[21] Appl. No.: 09/058,704

[22] Filed: Apr. 10, 1998

[51] Int. Cl.[6] ..... G09F 19/00

[52] U.S. Cl. ..... 40/410; 446/267; 472/65

[58] Field of Search ..... 40/410, 431; 472/65; 446/267

[56] References Cited

U.S. PATENT DOCUMENTS

| | | |
|---|---|---|
| 1,221,494 | 4/1917 | Wiley . |
| 2,361,423 | 10/1944 | Snyder . |
| 2,435,612 | 1/1948 | Snyder . |
| 2,543,606 | 2/1951 | Solomon et al. . |
| 3,147,175 | 9/1964 | Gonzalez . |
| 3,999,750 | 12/1976 | Perkins . |
| 4,028,830 | 6/1977 | Ottinger . |
| 4,076,234 | 2/1978 | Burnbaum . |
| 4,641,445 | 2/1987 | Rossi . |
| 4,686,784 | 8/1987 | Smithies . |
| 4,817,311 | 4/1989 | Ong . |
| 4,962,922 | 10/1990 | Chu . |
| 5,092,065 | 3/1992 | Teng . |
| 5,098,084 | 3/1992 | Culver . |
| 5,110,636 | 5/1992 | Hou . |
| 5,200,239 | 4/1993 | Chen . |
| 5,261,848 | 1/1993 | Kaplan et al. . |
| 5,291,674 | 3/1994 | Torrence . |
| 5,313,727 | 5/1994 | Murray, Jr. . |
| 5,442,869 | 8/1995 | McDarren et al. . |
| 5,491,916 | 2/1996 | Ingram et al. . |
| 5,632,419 | 5/1997 | Pickens . |
| 5,711,099 | 1/1998 | Nesbit et al. ..... 40/410 |

FOREIGN PATENT DOCUMENTS

| | | |
|---|---|---|
| 1083064 | 9/1967 | United Kingdom . |
| 2249858 | 5/1992 | United Kingdom ..... 40/410 |

*Primary Examiner*—Joanne Silbermann

*Attorney, Agent, or Firm*—Knobbe, Martens, Olson & Bear L.L.P.

[57] ABSTRACT

A device for producing a simulated snowfall is disclosed. The device comprises a display tank filled with water and a plurality of small pellets. A pump positioned on the upper side of the display tank creates water currents which flow around the perimeter of the display tank. The water is propelled out of the pump into an outflow tube extending down a first side of the display tank to a receiving trough positioned along the bottom side of the display tank. The pellets descend through the water to the receiving trough and are then carried horizontally across the receiving trough by a water current to a deflector plate which diverts the pellets and water current in an upward direction along the second side of the display tank. As the pellets reach the upper side of the display tank, they spread out uniformly and gradually descend through the water, creating a simulated snowfall with a natural appearance.

19 Claims, 5 Drawing Sheets

SNOWFALL SIMULATOR

BACKGROUND OF THE INVENTION

1. Field of the Invention

This invention relates generally to display devices, and specifically to display devices providing a simulated snowfall within a fluid.

2. Description of the Related Art

A conventional display device for providing simulated snowfall consists of a glass ball enclosing a fluid with small pellets or flakes disposed therein. The glass ball is shaken to randomly disperse the pellets throughout the fluid, and the pellets then gradually descend through the fluid to the bottom of the glass ball, giving the appearance of falling snow. Such a device has the obvious disadvantage of requiring someone to periodically shake it, a very difficult task when the display device is desired to be somewhat large.

More elaborate snowfall display devices include internal impellers or pumps for causing the pellets to move within the fluid. These devices typically have an impeller on the lower side of the display container which simultaneously thrusts some of the particles upward and draws others downward in the viewing area, creating a very artificial appearance because snowflakes do not move upward from the ground in a natural snowfall.

Moreover, in prior art attempts to solve the problem of hiding the upward-moving pellets from view, there is generally a relatively small intake hole on the bottom of the tank into which the fluid and pellets are drawn. Thus, the various fluid flow lines in these devices terminate in substantially the same area at the bottom of the tank, giving the impression that all of the "snowflakes" fall downward for some distance, then curve at the end of their path to reach a common point. Such a configuration also fails to provide a natural appearance of snowfall. In accordance with the present invention, there is desired an improved snowfall simulator which gives the natural appearance of snow falling from the top of a tank to the bottom of the tank in a continuous, natural fashion.

SUMMARY OF THE INVENTION

The present invention is a display device for producing a simulated snowfall within a display tank or container filled with liquid and a plurality of snowflake simulating elements. The device is arranged so that the snow elements are distributed along a top surface of the liquid in the tank and then fall downwardly towards a bottom of the tank through the liquid under the force of gravity.

The device defines a snow element flow path along the bottom of the tank and upwardly along a first side back to the top surface. Means are also provided for moving the snow elements along this path for returning them back to the top of the tank, whereby a continuous simulated snowfall is created.

The snow element path is preferably defined by a trough positioned at the bottom of the tank and a deflector positioned at the intersection of the bottom and side of the tank.

Preferably, the means for moving the snow elements comprises a liquid pump positioned at a top side of the display tank. The pump expels liquid through an outflow tube which extends along a side of the tank to the bottom. This liquid flows through the trough at the bottom of the tank, into which the snow elements reaching the bottom of the tank are drawn. The liquid containing snow elements is then deflected upwardly along the first side of the tank to the top of the tank. As the snow elements reach the upper side of the display tank, they spread out uniformly and gradually descend through the water, creating a simulated snowfall with a natural appearance.

Advantageously, a continuous simulated snowfall is created where the snow elements are evenly dispersed and those elements which are being returned to the top of the tank are routed along a periphery of the tank without interference with those which are falling.

Further objects, features and advantages of the present invention over the prior art will become apparent from the detailed description of the drawings which follows, when considered with the attached figures.

DETAILED DESCRIPTION OF THE PREFERRED EMBODIMENTS

In accordance with the present invention, there is provided a snowfall simulator which generally comprises a container for holding a fluid medium having simulated snow elements disposed therein, the simulator arranged so that the snow elements move throughout the container in a manner which simulates natural falling snow within the confines of the container.

Figure 2:
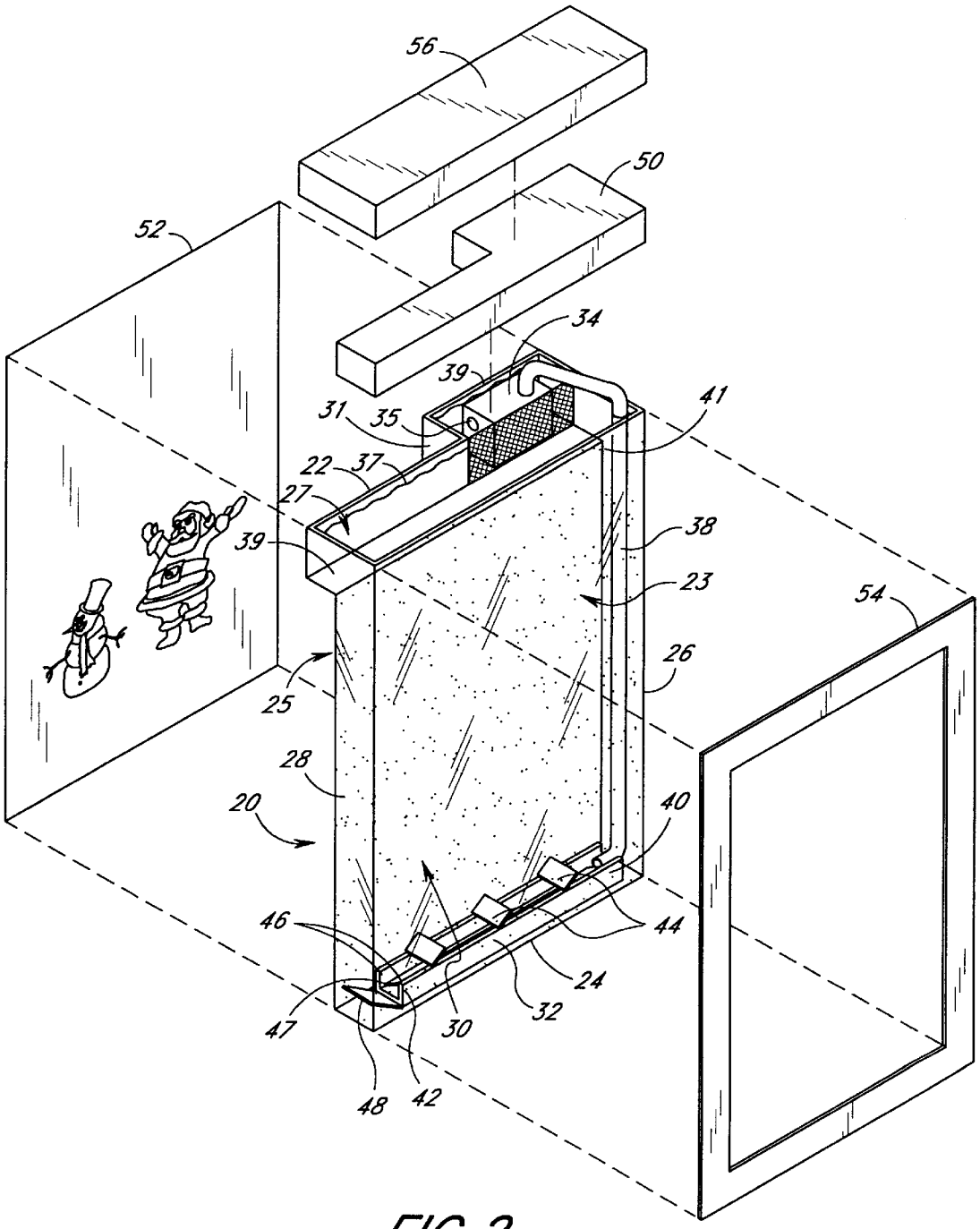
FIG. 2 is an exploded view of the snowfall simulator of FIG. 1.

As seen in FIG. 2, in a preferred embodiment of the present invention, the container is preferably a display tank 20 with a top 22, a bottom 24, a first side 26, a second side 28, a front surface 23 and a rear surface 25. The top 22, bottom 24 and sides 26,28 space the front and rear surfaces 23,25 apart from one another, preferably by a relatively small distance in relation to the size of the front and rear surfaces 23,25. In the preferred embodiment, the distance between the front and rear surfaces 23,25 near the bottom 24 is about ¼" to ¾" inches. The distance between the top and bottom 22,24 can range from a few inches to several feet, as may the distance between the sides 26,28. Those of skill in the art will appreciate that the exact shape and dimensions of the tank 20 may vary.

The front surface 23 is preferably generally rectangular in shape. The rear surface 25 has a generally rectangular section but is also defined by a pair of outwardly extending sections. In particular, a short distance below the top 22, the rear surface 25 extends outwardly from the front surface 23 towards the rear, creating a generally horizontal ledge 39. This ledge 39 extends between the sides 26,28.

Near the first side 26 of the tank 20 the rear surface 25 extends further rearwardly, forming a pumping chamber. This chamber has a floor which is at the same level as the ledge 39.

The sides 26,28, bottom 24 and front and rear surfaces 23,25 are preferably defined by translucent or clear material, such as glass, plastic or the like. The top 22 of the display tank 20 is preferably closed or sealed with a similar material to prevent entry into an interior space 27 of the tank 20.

A peripheral edge of the container comprises that portion of the interior space 27 immediately adjacent to the top 22, bottom 24, and sides 26, 28 of the display tank 20, and hence extending around the perimeter of the front surface 23.

A fluid medium is contained within the interior space 27 defined by the display tank 20. In the preferred embodiment, the fluid medium comprises water. The fluid medium may comprise other liquids which are sufficiently translucent to permit viewing of the snow elements, as described below.

The water preferably generally fills the tank 20, with a top surface 37 of the water within the tank positioned just below the top 22 of the tank.

Simulated snow elements 30 are positioned in the fluid medium. The snow elements 30 may be small flakes or pellets which resemble snow. The snow elements may comprise pellets of a polymer material known as PVC.

The composition and size of the snow elements or pellets 30 is preferably chosen in conjunction with the fluid medium so that the medium provides a resistance to the downward motion of the snow elements 30 under the force of gravity. In this manner, the elements 30 descend through the fluid at a rate which is approximate to the descent rate of a snowflake through air. To achieve this result, the type of medium and snow elements must be chosen such that the snow elements 30 have a somewhat heavier specific gravity than the medium.

There is also provided means for moving the snow elements 30 through the medium. As illustrated, this means is a pump 34 having an impeller positioned in a housing. The means also may be an unhoused impeller, rotating shaft, or the like. As seen in the preferred embodiment of FIG. 1, the pump 34 is positioned in the pump chamber near the top 22 of the display tank 20. The pump 34 preferably has at least one intake port 35.

Figure 4:
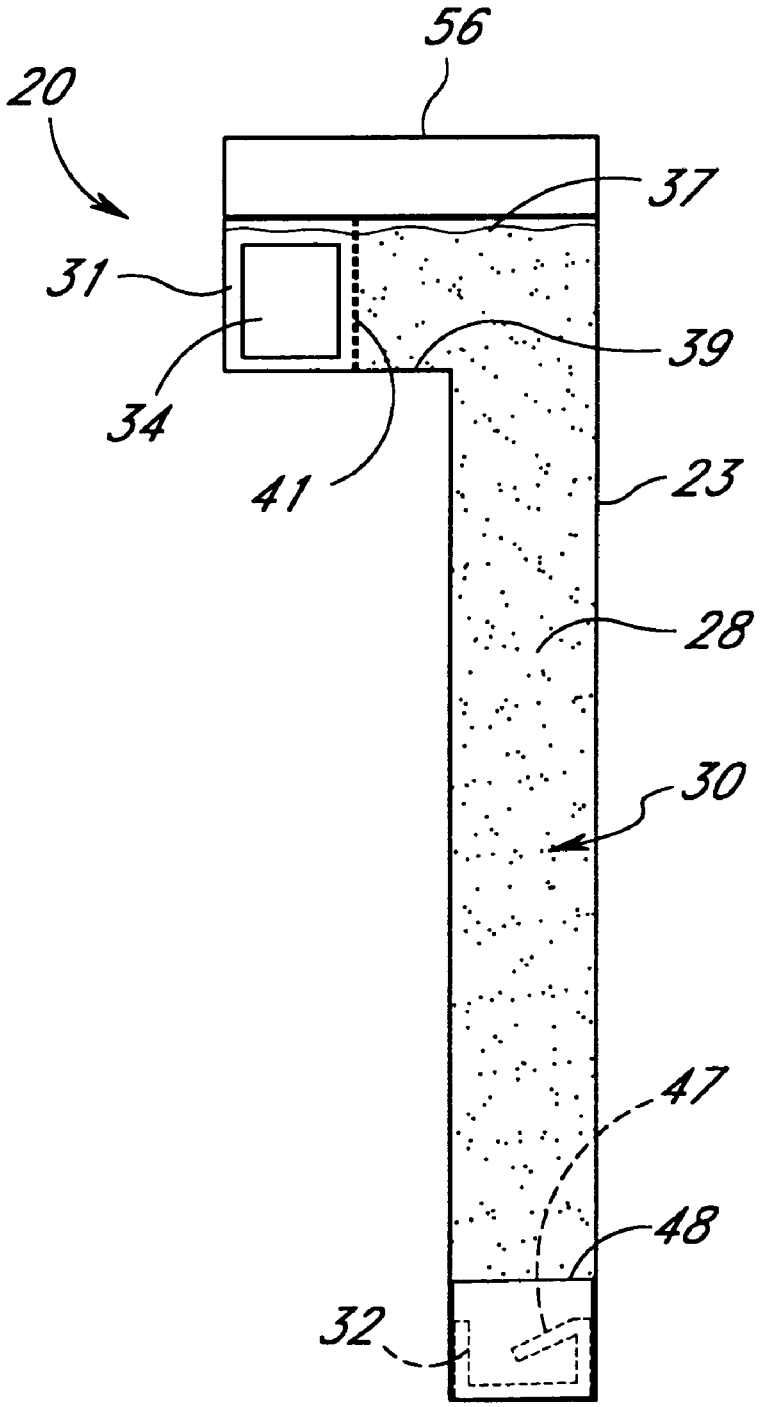
FIG. 4 is a side view of the snowfall simulator taken in the direction of line 4—4 of FIG. 3.

A screen 41 is preferably extends between the first side 26 and a rearwardly extending wall 31 to prevent snowfall elements 30 from being drawn into the pump 34. As illustrated, in FIGS. 1 and 4, the screen 41 extends generally parallel to the front surface 23. The screen 41 extends upwardly from the ledge 39.

An outflow tube 38 preferably extends from the pump 34 along the first side 26 of the display tank 20, and connects to a first end 40 of a receiving trough 32.

Means are provided for routing the snowfall elements 30 which have fallen from the top 22 to the bottom 24 of the tank 20 back to the top 22 of the tank 20. Preferably, this means is arranged to route the elements 30 from the bottom 24 of the tank 20 along a peripheral edge or perimeter of the tank and then distribute them generally evenly through the water from side-to-side near the top 22 of the tank 20.

Preferably, this means includes the receiving trough 32. This trough 32 preferably has a U-shaped cross section with vertical sides 46, a diverter 47, a first end 40 and a second end 42. The trough 32 is positioned inside the tank 20 along the bottom 24 thereof. In the embodiment illustrated, the trough 32 comprises an element which is separate from the tank 20 and inserted therein. It will be understood by those of skill in the art, however, that the trough 32 may be formed entirely or partially integrally with the remainder of the tank. For example, the bottom and side portions of the trough 32 may comprise the bottom 24 and front and rear surfaces 23,25 of the tank 20 instead of entirely separate surfaces.

The diverter 47 preferably comprises a member extending from the top of the side 46 closest the front surface 23 of the tank into the trough 32. Preferably, the diverter 47 extends downwardly into the trough 32 at approximately a 45° angle with respect to the side 46. The diverter 47 partially encloses the trough 32 between the vertical sides 46 thereof. The diverter 47 thus cooperates with the vertical sides 46 and bottom of the trough 32 to define an inlet area through which descending pellets 30 are guided and a main flow area through the trough 32.

A plurality of baffles 44 are preferably attached to the top of each side 46 of the trough 32, at an angle of approximately forty-five degrees (45°) with respect thereto. The baffles 44 thus span the trough 32 at the top of the vertical sides 46 thereof. Each baffle 44 is tilted in the direction of the first side 26 of the tank 20.

The baffles 44 as arranged as described to diminish the formation of disruptive currents at the interface between the water flowing through the receiving trough 32 and the substantially still water in the central region of the display tank 20. The baffles 44 tend to aid in the elements 30 being drawn into the liquid flowing through the trough 32 and being trapped therein. In this manner, elements 30 which fall to the bottom 24 of the tank 20 are drawn into the water flowing through the trough 32.

The means for defining the path of the elements 30 also preferably includes a deflector 48 which is positioned, preferably at an angle of approximately 45 degrees with respect to the bottom 24 of the display tank 20, near the second end 42 of the receiving trough 32 (and thus near the intersection of the bottom 24 and second side 28 of the tank 20). This deflector 48 facilitates the deflection of the liquid containing pellets 30 flowing along the bottom of the tank 20 upwardly along that portion of the peripheral edge of the tank 20 adjacent to the second side 28.

Means are also preferably provided for illuminating the snow pellets 30 and making them more readily visible as they move through the fluid. Preferably, this means comprises an illumination source 50.

As shown in FIG. 2, this source comprises an electrically powered light which is removably secured to the tank 20 at its top 22. The source 50 projects light into the tank 20, causing light to reflect off of the descending pellets 30, thereby highlighting the pellets and further enhancing the natural appearance of snowfall. The illumination source 50 also preferably serves to highlight a decorative scene 52 which may be positioned to be viewed in connection with the display tank 20.

Figure 1:
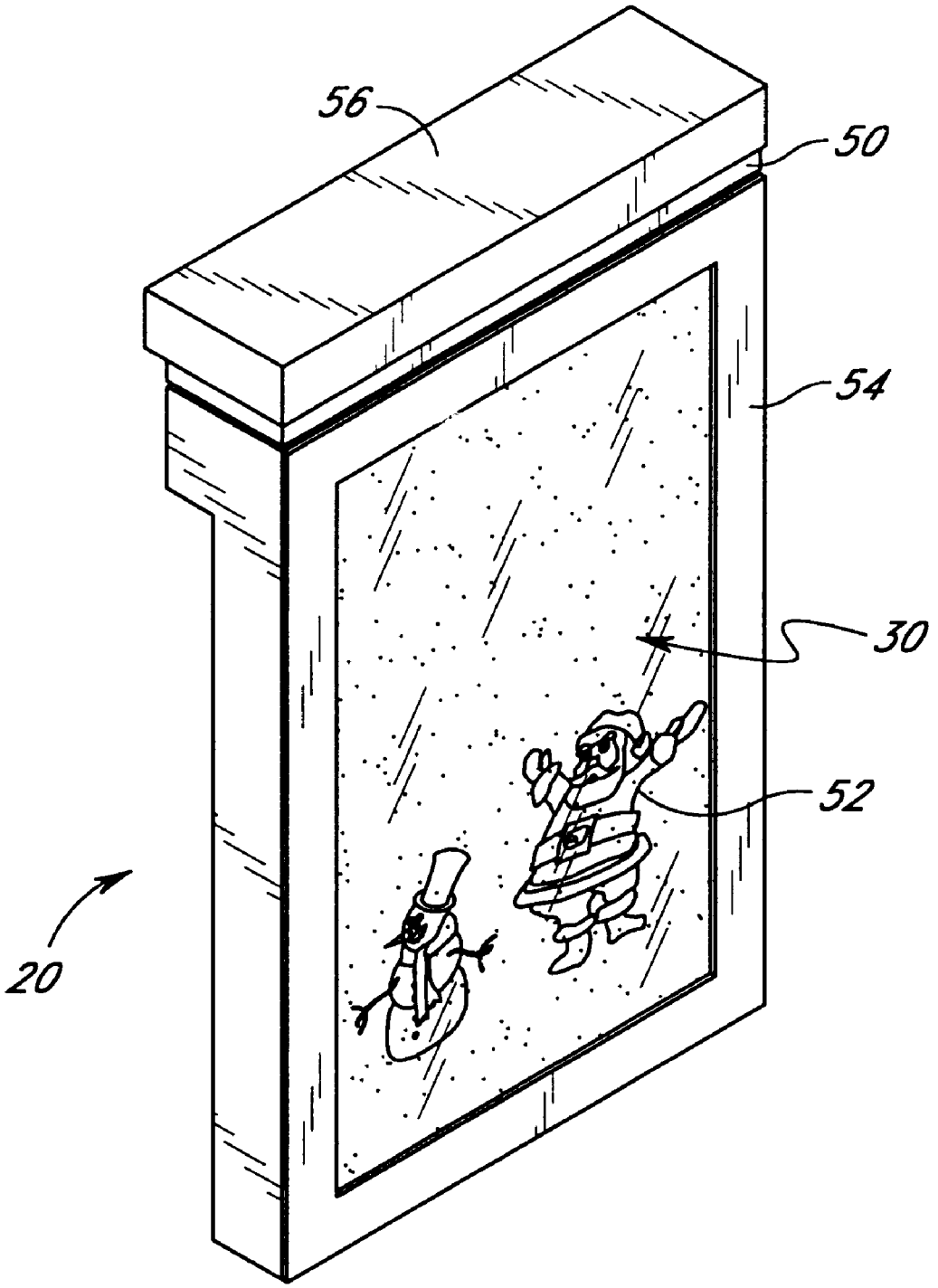
FIG. 1 is a perspective view of a snowfall simulator device of the present invention.

As seen in FIGS. 1 and 2, the decorative scene 52 is preferably placed behind the display tank 20 to provide the appearance of snow falling in front of the scene. In the alternative, the decorative scene 52 may also be placed in front of the display tank 20 with some part of the display tank 20 visible through an opening in the decorative scene 52. Such a configuration is contemplated, for example, when the appearance of snowfall is desired through a simulated window in a larger display. A decorative display, including three-dimensional figures, for example, may also be placed inside the display tank 20 so that the snow elements 30 fall on the scene.

A partial surface cover is preferably affixed in front 23 of the display tank 20 to cover at least some portion of the display tank 20. In the preferred embodiment shown in FIGS. 1 and 2, the partial surface cover is a frame 54, extending around the perimeter or peripheral edge of the display tank 20. The frame thus hides the pump 34, tube 38, trough 32, and perimeter currents and pellet flow around the periphery of the tank out of view as shown in FIG. 1. In addition, a top cover 56 is preferably removably secured to the upper side 22 of the display tank 20, over the illumination source 50, to enclose the display device. The frame 54 may define window "frame" elements giving the appearance of viewing falling snow through a multi-pane window.

Figure 3:
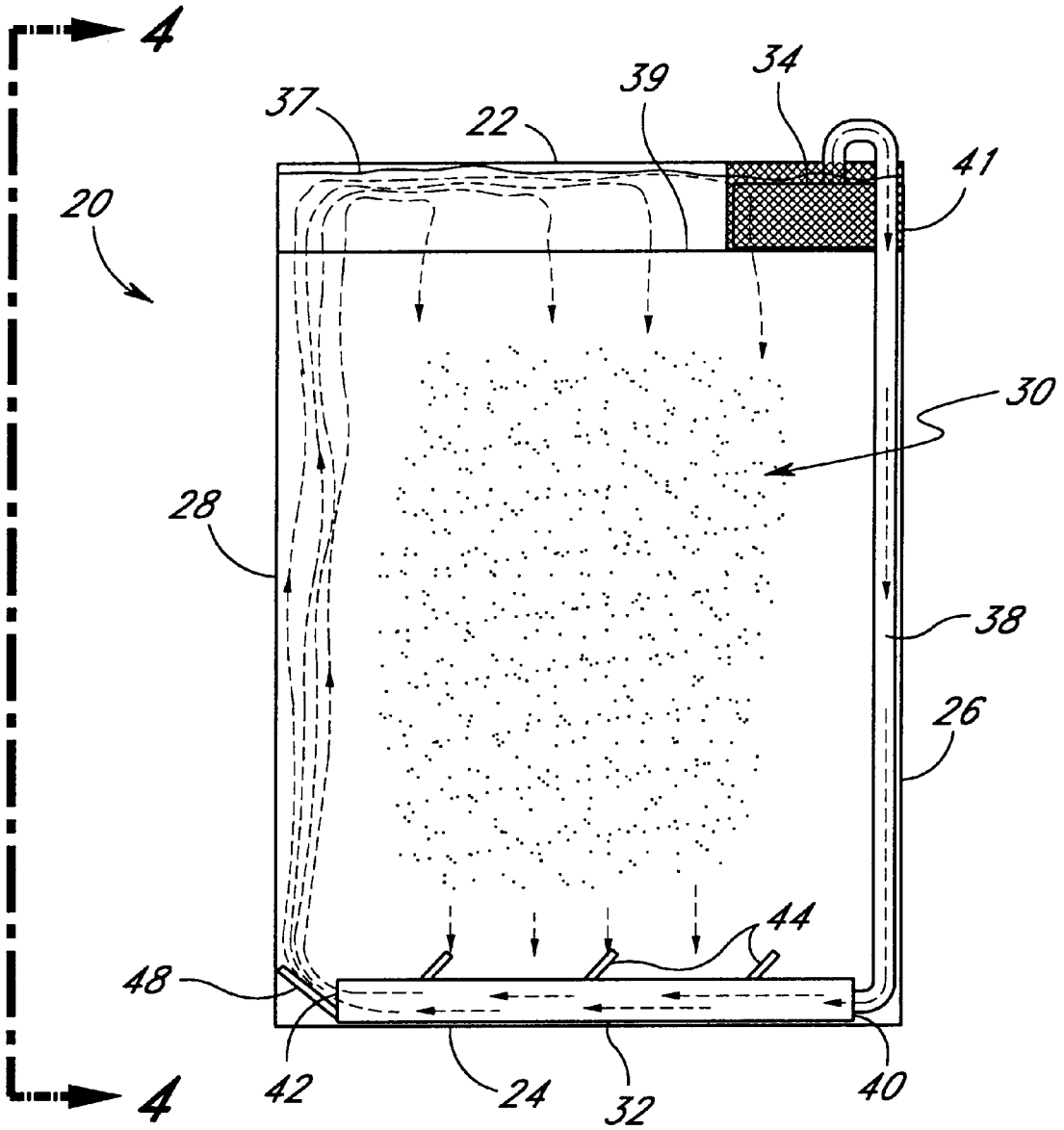
FIG. 3 is an elevational view of the snowfall simulator of the present invention illustrating the path of simulated snow elements through a container of the simulator.

The movement of the pellets 30 through the display tank 20 will now be described in detail with reference to FIG. 3. The pellets 30 gradually descend through the water in the display tank 20 to the receiving trough 32 positioned along the lower side 24 of the display tank 20. The pump 34 draws water horizontally across the top surface 37 of the water, through the screen 41, and into the intake port 35 (see FIG. 2). As described above, the screen 41 serves to prevent stray pellets 30 from entering the intake port 35 of the pump 34.

The pump 34 then propels the water into the outflow tube 38, which extends along the first side 26 of the display tank 20. This water flows at high velocity through the outflow tube 38 to the first end 40 of the receiving trough 32, and then through the trough 32. Due to the construction of the trough 32, a vortex is created therein. This vortex is primarily induced by the diverter 47. As the descending pellets 30 reach the receiving trough 32 at the lower side 24 of the display tank 20, they are drawn into the water vortex moving through the trough 32 and move in a horizontal direction defined from the first end 40 to the second end 42 of the receiving trough 32.

When the water current and pellets 30 emerge from the second end 42 of the receiving trough 32, they are deflected in an upward direction by the deflector plate 48, positioned near the comer formed by the lower side 24 and the second side 28, along the second side 28 of the display tank 20.

Upon reaching the top 22 of the display tank 20, the water current and pellets 30 are drawn partially across the tank 20 towards the first side 26 by the suction of the pump 34 into that portion of the interior space 27 between the ledge 39 and the upper surface 37 of the water. The pellets 30 gradually lose lateral velocity and the pull of gravity causes them to begin falling through the water towards the bottom 24.

The small differences in the weight of the pellets 30 and the slight variation in their respective paths of travel within the water current results in a substantially uniform dispersion of the pellets along the upper side 22 of the display tank 20 as the pellets begin their descent through the water.

Water currents produced across the ledge 39 serve to aid in the increase of pellet 30 distribution across the width of the tank 20. Also, these currents prevent the pellets 30 from gathering on the ledge 39.

As shown in FIG. 2, the preferred embodiment of the snowfall simulator of the present invention provides an aesthetically pleasing, substantially uniformly dispersed, simulated snowfall in connection with a decorative scene 52, while obscuring the mechanical parts and perimeter currents, including the upward transport of the elements 30, from view.

Figure 5:
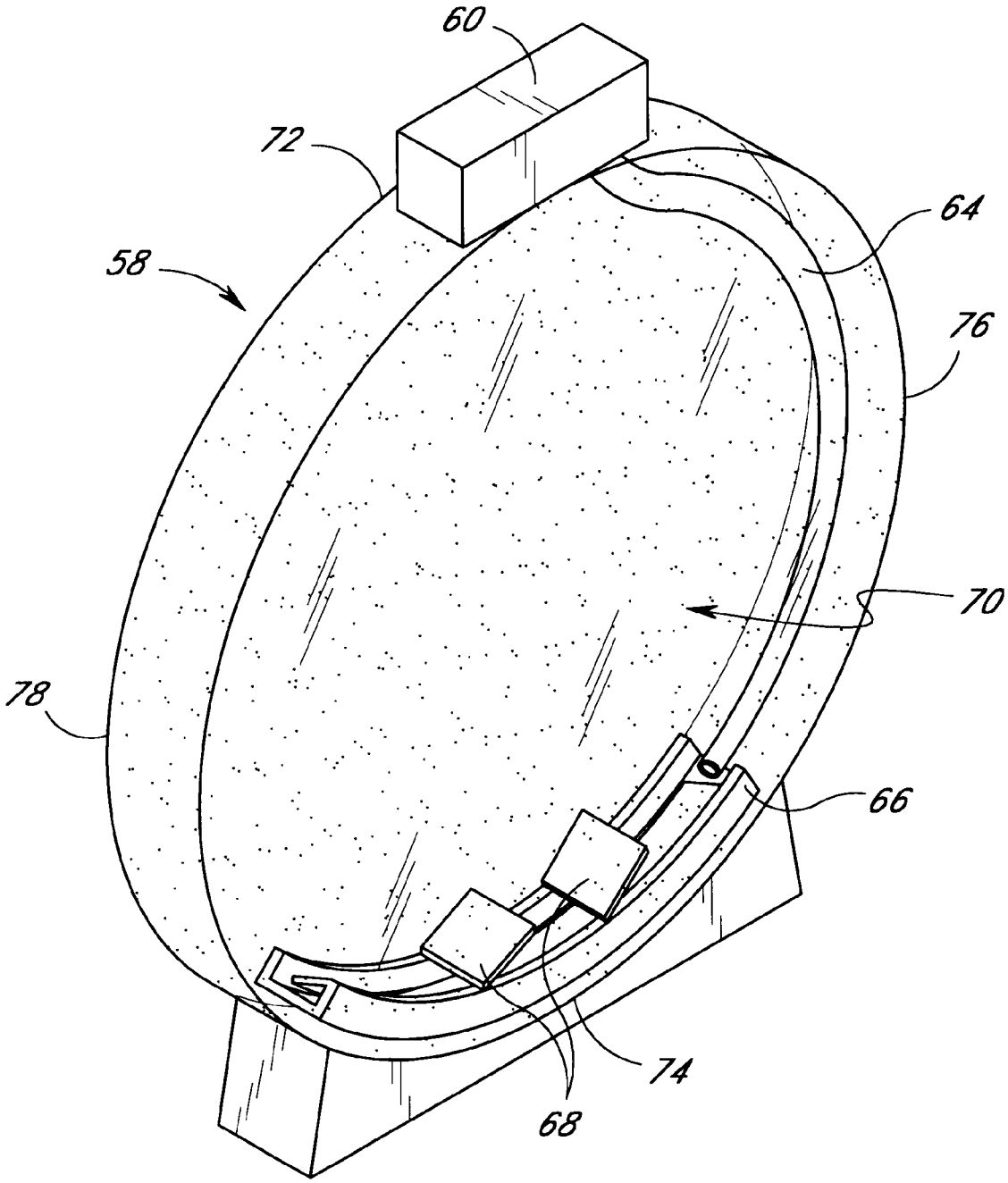
FIG. 5 is a perspective view of an alternative embodiment snowfall simulator of the present invention.

As shown in FIG. 5, an alternative embodiment of the present invention comprises a water-filled display tank 58 with a circular cross-section. As with the embodiment shown in FIGS. 1, 2, and 3, the alternative embodiment comprises a pump 60, an outflow tube 64, a receiving trough 66, and baffles 68. In this alternative embodiment, however, the upper and lower sides 72, 74, and the first and second sides 76, 78 are each segments of an arc such that all of these sides together form a display tank 58 with a circular cross-section. The pellets 70 descend through the water disposed within the display tank 58 and circulate around the tank in the same manner as in the embodiment shown in FIGS. 1, 2, and 3.

While it is preferred that a deflector 48 be included, this element is not entirely necessary, as when the water and pellets 30 exit the through 32 they are deflected upwardly by the second side 28. The deflector 48 provides for a smoother transition of the water and pellets 30, reducing the likelihood that some pellets 30 may deflect out into the main part of the tank 20.

While the front and rear surfaces 23,25 are preferably planar, it is possible for the surfaces to be only generally planar, i.e., slightly convex or concave. For example, if the front surface 23 is slightly convex, a magnification effect is produced.

Those of skill in the art also will appreciate that the screen 41 may be omitted if the pump or other flow-inducing means will pass the snow pellets 30 without damage to either the pump or pellets 30.

It will be understood that the above-described configurations are merely illustrative of applications of the principles of this invention and many other embodiments and modifications may be made without departing from the spirit and scope of the invention as defined in the claims.

I claim:

1. A display device comprising:

a container having a top and a bottom, a generally planar front surface and a generally planar rear surface and first and second sides;

a liquid disposed in said container, said liquid having a top surface;

a plurality of simulated snow elements disposed within said liquid;

means for channeling said snow elements along a flow path along said bottom of said container and upwardly along said first side and across said top surface of said container, whereby snow elements which are dispersed through said liquid at said top surface thereof descend through said liquid with the aid of gravity and are then returned to said top of said container; and means for moving said snow elements which fall to said bottom of said container alone said flow path, said moving means including a trough positioned at said bottom of said container, and said trough having at least one baffle extending across a top of said trough, wherein said snow elements move in a direction through said trough from a first end to a second end, said at least one baffle having a bottom edge and a top edge, and said top edge being positioned closer to said second end of said trough than said bottom edge.

2. The display device in accordance with claim 1, wherein said means for channeling said snow elements includes a deflector positioned at an intersection of said bottom and said first side of said container.

3. The display device in accordance with claim 1, further including means for illuminating said snow elements.

4. The display device in accordance with claim 1, wherein said means for channeling is positioned at said top of said container.

5. The display device in accordance with claim 1, further comprising a partial surface cover for obscuring some portion of said front surface of said device.

6. The display device in accordance with claim 5, wherein said partial surface cover is a frame.

7. The display device in accordance with claim 1, further comprising a decorative scene positioned adjacent said rear surface of said container, said decorative scene adapted to be viewable through said container from said first surface.

8. The display device in accordance with claim 1, wherein said means for channeling has an outlet tube extending along said second side of said container to said bottom of said container.

9. The display device in accordance with claim 1, wherein said means for channeling is arranged to draw liquid from said top surface of said liquid.

10. The display device in accordance with claim 1, wherein said first and second sides of said container are curved.

11. A display device comprising:

a container having a top and a bottom, a generally planar front surface and a generally planar rear surface and first and second sides;

a liquid disposed in said container, said liquid having a top surface;

a plurality of simulated snow elements disposed within said liquid;

means for channeling said snow elements along a flow path along said bottom of said container and upwardly along said first side and across said top surface of said container, whereby snow elements which are dispersed through said liquid at said top surface thereof descend through said liquid with the aid of gravity and are then returned to said top of said container; and means for moving said snow elements which fall to said bottom of said container along said flow path, said moving means including a pump, wherein an outlet tube of said pump extends along said second side of said container to said bottom of said container.

12. The display device in accordance with claim 11, wherein said means for channeling said snow elements includes a deflector positioned at an intersection of said bottom and said first side of said container.

13. The display device in accordance with claim 11, further including means for illuminating said snow elements.

14. The display device in accordance with claim 11, wherein said pump is positioned at said top of said container.

15. The display device in accordance with claim 11, further comprising a partial surface cover for obscuring some portion of said front surface of said device.

16. The display device in accordance with claim 15, wherein said partial surface cover is a frame.

17. The display device in accordance with claim 11, further comprising a decorative scene positioned adjacent said rear surface of said container, said decorative scene adapted to be viewable through said container from said first surface.

18. The display device in accordance with claim 11, wherein said pump is arranged to draw liquid from said top surface of said liquid.

19. The display device in accordance with claim 11, wherein said first and second sides of said container are curved.

* * * * *

UNITED STATES PATENT AND TRADEMARK OFFICE

CERTIFICATE OF CORRECTION

PATENT NO. : 5,979,091
DATED : November 9, 1999
INVENTOR(S) : Carl Even TenBrink It is certified that error appears in the above-identified patent and that said Letters Patent is hereby corrected as shown below:

Column 6,
Line 38, please change “alone” to -- along --.

Signed and Sealed this

Third day of September, 2002

*Attest:*

*Attesting Officer*

JAMES E. ROGAN
*Director of the United States Patent and Trademark Office*